United States Patent [19]

Musgrave

[11] Patent Number: 4,464,855

[45] Date of Patent: Aug. 14, 1984

[54] MAGAZINE FILLING DEVICE

[76] Inventor: Daniel D. Musgrave, 8201 Caraway St., Cabin John, Md. 20818

[21] Appl. No.: 395,286

[22] Filed: Jul. 6, 1982

[51] Int. Cl.[3] ..... F41C 27/00

[52] U.S. Cl. ..... 42/87

[58] Field of Search ..... 42/87, 90, 1 R

[56] References Cited

U.S. PATENT DOCUMENTS

| | | | |
|---|---|---|---|
| 2,466,017 | 4/1949 | Farber | 42/90 |
| 3,153,296 | 10/1964 | Hofstetter | 42/87 |
| 3,710,497 | 1/1973 | Musgrave | 42/87 |
| 3,854,232 | 12/1974 | Musgrave | 42/87 |
| 4,291,483 | 9/1981 | Musgrave | 42/87 |
| 4,304,062 | 12/1981 | Pepe et al. | 42/87 |

FOREIGN PATENT DOCUMENTS

| | | | |
|---|---|---|---|
| 304379 | 2/1921 | Fed. Rep. of Germany | 42/87 |
| 555367 | 8/1943 | United Kingdom | 42/90 |

*Primary Examiner*—Charles T. Jordan

[57] ABSTRACT

A device for facilitate insertion of cartridges into a magazine used in a firearm. The device is adapted to enter the feed mouth of a magazine and depress the topmost cartridge therein. The device also serves as a loading tray to guide the next incoming cartridge into the feed mouth.

12 Claims, 12 Drawing Figures

MAGAZINE FILLING DEVICE

Cartridge magazines for firearms have been developed to a high standard of efficiency. For military purposes there is a trend toward magazines with a large capacity. Some of these large capacity magazines employ a single ramming position, with two feed lips spaced apart a distance less than the diameter of a cartridge. With such an arrangement cartridges can only be inserted into the magazine singly. Because of the small size of the cartridge and the fact that they must be inserted against the resistance of the magazine spring, the filling process is inconvenient, particularly when the user is chilled, fatigued, or tense.

The principal object of this invention is to provide a device which will facilitate filling a magazine with cartridges.

Another object is to provide such a device which will be compact and light in weight.

Another object is to provide such a device which will be economical to fabricate.

These and other objects of the present invention will become apparent upon reference to the following specification, taken in connection with the accompanying drawings, wherein.

Figures 1, 2, 3, 4, 5, 6, 7, 8, 9, 10, 11, 12:
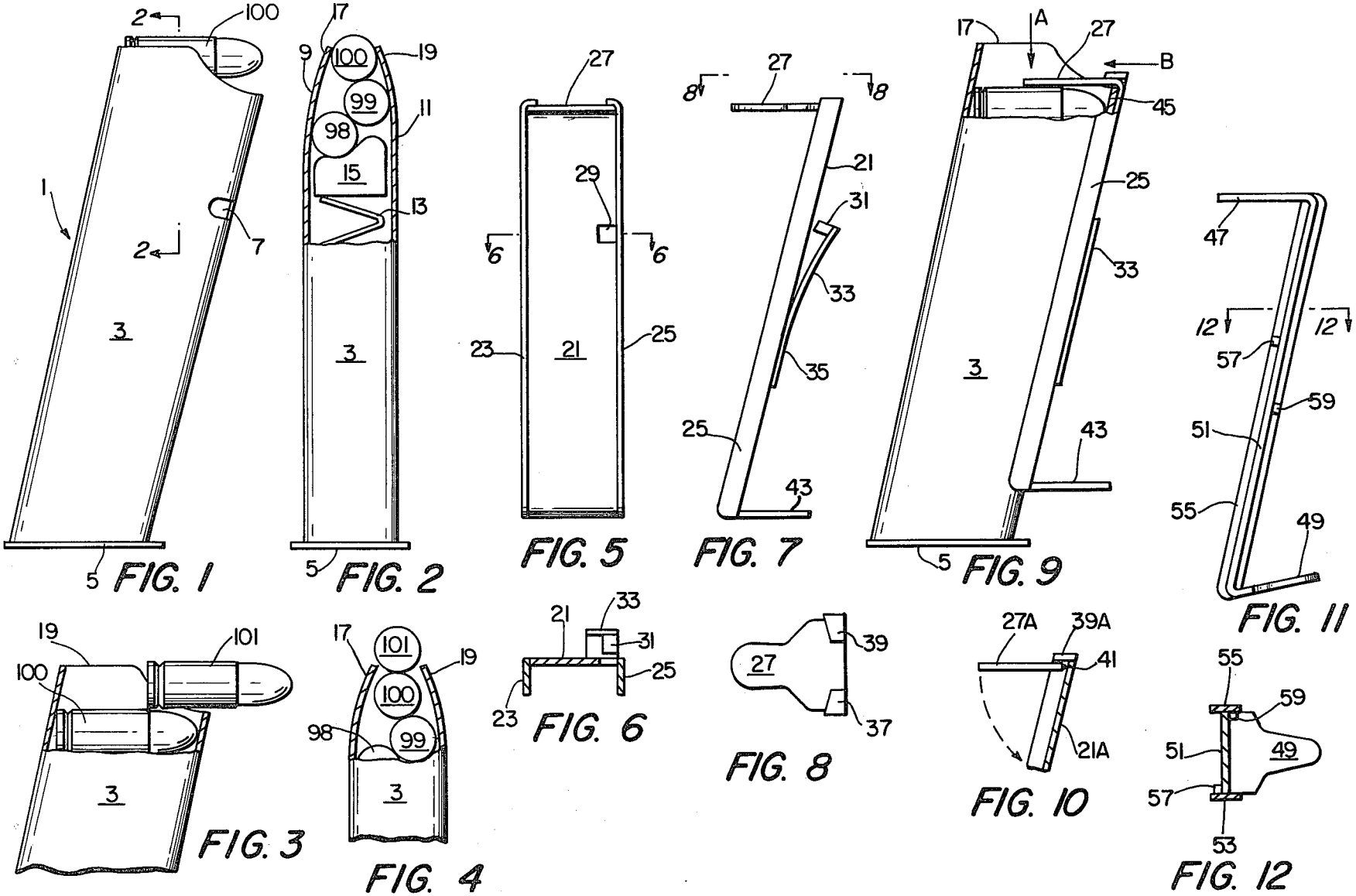
FIG. 1 is a side elevation of a cartridge magazine.
FIG. 2 is a front view of the same magazine partly sectioned as indicated by lines 2—2 on FIG. 1.
FIG. 3 is similar to the upper portion of FIG. 1, but partly sectioned.
FIG. 4 is similar to the upper portion of FIG. 2, but elements have been moved.
FIG. 5 is a front view of a magazine filling device.
FIG. 6 is a horizontal section taken in the plane indicated by lines 6—6 on FIG. 5.
FIG. 7 is a side view of the device shown in FIG. 5.
FIG. 8 is a top view of the device shown in FIG. 7.
FIG. 9 shows a magazine filling device positioned on a magazine.
FIG. 10 shows an alternate detail of construction of a magazine filling device.
FIG. 11 shows a magazine filling device which can be used with a plurality of dissimilar magazines.
FIG. 12 is a horizontal section taken in the plane indicated by lines 12—12 on FIG. 11.

The drawings have been prepared for the purposes of disclosing the invention. No particular magazine is shown, and the device is capable of being used with magazines differing substantially from that illustrated. The drawings should not be construed as limitations on the invention. They are merely exemplary.

Referring to the drawings in detail, FIG. 1 shows a typical cartridge magazine 1, of a type well-known in the art. Magazine 1 includes a casing 3, a floor 5, and a notch 7 formed in the casing. The purpose of the notch is to provide an engagement surface for a latch (not shown) which is adapted for retaining the magazine in a feeding position in a firearm. A cartridge 100 is partly visible at the top of the magazine.

In FIG. 2 the same magazine is shown in a cross-section taken as indicated by lines 2—2 of FIG. 1. The side walls of the casing are numbered 9 and 11, respectively. Within the casing a spring 13 is thrusting a cartridge follower 15 upward against a cartridge 18 which in turn forces cartridge 99 against cartridge 100, which rests against the inwardly turned ends of 9 and 11. These ends are commonly known as the feed lips, and they are numbered 17 and 19 respectively. The portion of a magazine which includes the feed lips is frequently called the feed mouth.

It should be understood that in the drawings, the "front" of the magazines, or cartridges, in FIGS. 1, 3, and 9, is at the right side of the drawings.

Magazines of the type shown in FIGS. 1 and 2 are used extensively in pistols because they provide a large cartridge capacity. They are however, somewhat inconvenient to fill by hand, particularly if the users hands are chilled. This will be understood by reference to FIGS. 3 and 4 which show the method of filling, normally employed.

The user holds a cartridge 101 in his fingers and pushes it downward against the front portion of cartridge 100. (He cannot push against the rear portion because the gap between lips 17 and 19 is less than the diameter of a cartridge.)

When cartridge 100 is sufficiently depressed, cartridge 101 can be moved under lips 17 and 19. The above procedure is repeated until the magazine is filled to capacity. However, FIG. 3 is somewhat schematic as it shows an ideal relationship between the incoming cartridge and the top cartridge in the magazine. As can be understood by reference to FIG. 4, such an ideal condition does not occur in actual practice.

The cartridges are substantially cylindrical and they tend to roll over one another as the stack of cartridges within the magazine is depressed. By comparison of FIGS. 3 and 4 it will be understood that cartridge 100, while being depressed, is virtually uncontrolled at its rear, and is poorly controlled between cartridges 99 and 101 at its front. This poor control of the top cartridge, when depressed is the principal cause of difficulty in filling a magazine of the type shown in FIGS. 1 and 2.

The present invention comprises a magazine filling device which provides a substantial degree of mechanical control for the said top cartridge when depressed during the filling operation. FIGS. 5, 6, 7 and 8 disclose such a device. The device comprises a base 21 made substantially in the form of a channel with sides 23 and 25, having a tray 27 affixed by any convenient method to its upper end. The dimensions of the tray are so chosen that it may pass between lips 17 and 19 of the magazine, as will be explained in detail hereinafter.

Formed through base 21 is a hole 29 which is intended to permit passage of a latch 31, flexibly mounted on the base by means of a curved spring 33, the spring being affixed to the base at 35 in any convenient manner. The tray can be reinforced by bending the top edges 37 and 39 of sides 25 and 23 respectively, down against the tray. A handle 43 is formed at the lower end of the base. The handle can be made by simply bending a portion of the base in the configuration shown.

As an alternate the tray can be arranged to fold as shown in FIG. 10. Tray 27A is pivoted at 41 so as to be capable of folding against base 21A. When unfolded, it stops against top edge 39A.

The method of using the magazine filling device is disclosed in FIG. 9. The device is positioned against the front of casing 3 with sides 23 and 25 contacting walls 11 and 9 of the casing, respectively. By means of handle 43, the base with the tray is pulled down in the direction indicated by arrow A. Pressure on spring 33 can now engage latch 31 in notch 7 in the magasine, the position of the latch being so selected as to permit engagement when the base is depressed a predetermined distance, thereby also depressing the top cartridge in the magasine. During such a movement, sides 23 and 25 act as guides to keep the base properly aligned with the magazine.

The tray being thus depressed, a cartridge can be inserted under the lips of the magazine in the direction indicated by arrow B. The filling device is then removed in a direction opposite to that indicated by arrow B and the process is repeated until the magazine is full. By proper selection of the angle between tray 27 and base 21, it will be possible to depress the top cartridge sufficiently to insert another cartridge easily. It will also be found that the tray can readily pass over the top edge 45 of the front wall of the magazine casing during removal of the device.

As magazines for different models of guns differ slightly in configuration, it may be desirable to make the filling device with two dissimilar ends as shown in FIGS. 11 and 12. Trays 47 and 49 are formed at different angles with base 51, and either tray can serve as a handle. The base is provided with sides 53 and 55, and fixed latches 57 and 59 are provided, positioned so as to cooperate with tray 47 or with tray 49 respectively. The user will thus be able to choose the tray which is best adapted for use with his particular magazine.

The space between the front of the feed lips constitutes an exit port for the feeding of cartridges to a firearm. In FIG. 9 it will be noted that tray 27 is adapted to orient correctly a cartridge being inserted via said port as indicated by arrow B.

It is readily apparent that if magazine 3 in FIG. 9 were to be empty of cartridges, tray 27 could depress a cartridge follower within the magazine to permit insertion of the first cartridge therein.

There is thus disclosed a simple and compact magazine filling device which facilitates filling of a magazine under difficul conditions. The device can be made so compact that it can be carried on the person, or the equipment, of the user so as to be always available when needed.

I claim:

1. A cartridge magazine filling device comprising: a base having an angularly disposed tray for insertion into a feed mouth of a magazine; said tray having a bottom surface for depressing a cartridge positioned in said mouth toward a floor of said magazine; said tray having a top surface for guiding another cartridge into said mouth; and said tray being positionable between a top cartridge in said magazine and another cartridge in said magazine.

2. A magazine filling device as set forth in claim 1 wherein a portion of said tray passes between a pair of feed lips of said feed mouth.

3. A magazine filler device as set forth in claim 1 wherein said tray correctly orients a cartridge during insertion of said cartridge into said feed mouth.

4. A magazine filling device as set forth in claim 1 wherein said tray is removable from said mouth via a front cartridge exit port contiguous with said mouth.

5. A magazine filling device as set forth in claim 1 wherein said tray is affixed to said base.

6. A magazine filling device as set forth in claim 5 wherein said tray is pivotable relative to said base.

7. A magazine filling device as set forth in claim 5 wherein said base supports guide means for positionally retaining said device in a predetetermined relationship with said magazine.

8. A magazine filling device as set forth in claim 7 provided with latch means for engagement with a surface on said magazine.

9. A magazine filling device as set forth in claim 5 further provided with handle means affixed to said base, said handle means for moving said tray relative to said magazine.

10. A magazine filling device as set forth in claim 9 of unitary construction.

11. A unitary magazine filling device comprising: a base having a plurality of angularly disposed trays, each tray insertable into a feed mouth of a magazine, each tray having a bottom surface for depressing a cartridge at a position in a feed mouth of a magazine away from said position, and each tray having a top surface for guiding a cartridge into a feed mouth of a magazine.

12. A magazine filling device as set forth in claim 11 wherein each tray of said plurality is different from any other of said plurality.

* * * * *